US011117390B2

(12) United States Patent
Yamashita et al.

(10) Patent No.: US 11,117,390 B2
(45) Date of Patent: Sep. 14, 2021

(54) PRINTING APPARATUS AND PRESSING UNIT RETAINING METHOD

(71) Applicant: SEIKO EPSON CORPORATION, Tokyo (JP)

(72) Inventors: Norihiro Yamashita, Shiojiri (JP); Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 122 days.

(21) Appl. No.: 16/143,929

(22) Filed: Sep. 27, 2018

(65) Prior Publication Data

US 2019/0100029 A1 Apr. 4, 2019

(30) Foreign Application Priority Data

Sep. 29, 2017 (JP) ..... JP2017-191052

(51) Int. Cl.

*B41J 11/06* (2006.01)
*B41J 3/407* (2006.01)
*B41J 11/00* (2006.01)

(52) U.S. Cl.

CPC ..... *B41J 3/4078* (2013.01); *B41J 11/0005* (2013.01); *B41J 11/06* (2013.01); *B41P 2217/11* (2013.01); *B41P 2217/14* (2013.01)

(58) Field of Classification Search

CPC ... B41J 3/28; B41J 3/543; B41J 3/4078; B41J 11/06; B41J 13/10; B41J 11/005; B41P 2217/11; B41P 2217/14

See application file for complete search history.

(56) References Cited

U.S. PATENT DOCUMENTS 5,127,321 A * 7/1992 Proffer ..... B41F 15/10 101/114
6,883,425 B2 * 4/2005 Goss ..... B41F 15/0813 101/115
8,794,139 B2 * 8/2014 Keith ..... B41F 15/22 101/115
10,625,498 B2 * 4/2020 Martinez ..... B41F 15/0863

(Continued)

FOREIGN PATENT DOCUMENTS

JP H05-82162 11/1993
JP 2003-341178 12/2003

(Continued)

OTHER PUBLICATIONS

European Search Report issued in Application No. 18197521 dated Mar. 4, 2019.

*Primary Examiner* — Matthew G Marini
*Assistant Examiner* — Marissa Ferguson-Samreth
(74) *Attorney, Agent, or Firm* — Workman Nydegger

(57) ABSTRACT

A printing apparatus includes a printing unit configured to perform printing onto a medium, a supporting unit configured to support the medium to be printed by the printing unit, a pressing unit configured to be attachable and detachable with respect to the supporting unit and to be attached to the supporting unit to press the medium supported by the supporting unit, and a retainer configured to retain the pressing unit that is removed from the supporting unit. The retainer has a first portion on which the pressing unit is placed, and a second portion positioned closer to a leading end of the retainer than the first portion and above the first portion in a vertical direction.

8 Claims, 19 Drawing Sheets

(56) References Cited

U.S. PATENT DOCUMENTS

| | | | | |
|---|---|---|---|---|
| 2003/0197772 | A1* | 10/2003 | Iwatsuki | B41J 11/06 347/104 |
| 2004/0179081 | A1* | 9/2004 | Nimi | B41J 2/01 347/104 |
| 2005/0178309 | A1* | 8/2005 | Yamada | D05B 19/00 112/470.05 |
| 2008/0072775 | A1* | 3/2008 | Landesman | B41F 15/0863 101/115 |
| 2011/0242189 | A1* | 10/2011 | Okada | D06P 5/30 347/20 |
| 2012/0206552 | A1 | 8/2012 | Uchino | |
| 2013/0104762 | A1* | 5/2013 | Yanagishita | B41J 3/4078 101/407.1 |
| 2013/0278695 | A1 | 10/2013 | Yanagishita et al. | |
| 2013/0278698 | A1 | 10/2013 | Takeuchi et al. | |
| 2013/0314483 | A1 | 11/2013 | Moriya et al. | |
| 2016/0009109 | A1* | 1/2016 | Yanagishita | B41J 3/4078 347/104 |
| 2017/0203593 | A1 | 7/2017 | Hayashi | |
| 2018/0056675 | A1* | 3/2018 | Watanabe | B41J 11/06 |
| 2018/0170087 | A1* | 6/2018 | Kobayashi | B41J 3/4078 |

FOREIGN PATENT DOCUMENTS

| | | |
|---|---|---|
| JP | 2013-221229 | 10/2013 |
| JP | 2013-226657 | 11/2013 |

* cited by examiner

PRINTING APPARATUS AND PRESSING UNIT RETAINING METHOD

BACKGROUND

1. Technical Field

The invention relates to a printing apparatus and a pressing unit retaining method.

2. Related Art

In the related art, variously configured printing apparatuses have been used. In the printing apparatuses, such a printing apparatus has been used that is configured to perform printing onto a medium supported by a supporting unit, for example.

For example, JP-A-2013-221229 discloses an ink jet textile printing apparatus (printing apparatus) configured to press, with a frame (pressing unit), a target textile (medium) supported by a supporting unit having a set tray, for example, and to perform printing onto the target textile.

In the ink jet textile printing apparatus disclosed in JP-A-2013-221229, the frame is configured to be attachable and detachable with respect to the supporting unit. A retaining space is provided for appropriately retaining the frame that is detached. If the provided retaining space is not appropriate, the frame may fall off, or be lost. As described above, such a known printing apparatus equipped with a pressing unit configured to be attachable and detachable with respect to a supporting unit and to be attached to the supporting unit to press a medium supported by the supporting unit sometimes faces difficulty in appropriately retaining the pressing unit.

SUMMARY

An advantage of the invention is to appropriately retain a pressing unit configured to be attachable and detachable with respect to a supporting unit and to be attached to the supporting unit to press a medium supported by the supporting unit.

In view of the above described issue, a printing apparatus according to a first aspect of the invention includes a printing unit configured to perform printing onto a medium, a supporting unit configured to support the medium to be printed by the printing unit, a pressing unit configured to be attachable and detachable with respect to the supporting unit and to be attached to the supporting unit to press the medium supported by the supporting unit, and a retainer configured to retain the pressing unit that is detached from the supporting unit. The retainer has a first portion on which the pressing unit is to be placed, and a second portion positioned closer to a leading end of the retainer than the first portion and above the first portion in a vertical direction.

According to the aspect, the retainer configured to retain the pressing unit that is detached from the supporting unit is included. The retainer has the first portion on which the pressing unit is to be placed, and the second portion positioned closer to the leading end of the retainer than the first portion and above the first portion in the vertical direction. This allows the retainer to retain the pressing unit, where the retainer allows the pressing unit to be placed on the first portion, and prevents, by the second portion, the pressing unit from being detached from the retainer, such that the retainer appropriately retains the pressing unit (the pressing unit is prevented from falling off and from being lost, for example).

A printing apparatus according to a second aspect of the invention includes, in the first aspect, a plurality of the retainers.

According to the aspect, the printing apparatus includes the plurality of the retainers, and thus allow the plurality of the retainers to retain the pressing unit particularly securely. In a configuration where a supporting unit is replaceable with another supporting unit of a plurality of supporting units with different sizes and a pressing unit is replaceable with another pressing unit of a plurality of pressing units with different sizes, the printing apparatus allows the plurality of the retainers to support the plurality of pressing units with different sizes.

A printing apparatus according to a third aspect of the invention, in the second aspect, has spacings among the plurality of the retainers. The spacings are configured to be adjustable.

According to the aspect, the printing apparatus is configured to adjust spacings among the plurality of the retainers, and in a configuration where a supporting unit is replaceable with another supporting unit of a plurality of supporting units with different sizes and a pressing unit is replaceable with another pressing unit of a plurality of pressing units with different sizes, the printing apparatus allows the plurality of the retainers to support the plurality of pressing units with different sizes by adjusting the spacings among the plurality of the retainers.

In a printing apparatus according to a fourth aspect of the invention, in any one of the first to third aspects, the retainer is configured to be detachable from the printing apparatus.

According to the aspect, the retainer is configured to be detachable from the printing apparatus, and the retainer can easily be detached when the retainer is not to be used or is to be replaced.

In a printing apparatus according to a fifth aspect of the invention, in the fourth aspect, the supporting unit is configured to be movable within a movement range, the movement range including a set position for the medium to be set. The retainer is attached at a position allowing, when the supporting unit is positioned at the set position, the supporting unit to prevent the retainer from being detached form the printing apparatus.

According to the aspect, when the supporting unit is positioned at the set position, the retainer is configured to be attached at a position that allows the supporting unit to prevent the retainer from being detached from the printing apparatus. This can prevent such an event that the retainer is detached unintentionally due to external factors and the like, such as a contact by a user when the user is setting a medium.

A printing apparatus according to a sixth aspect of the invention includes, in any one of the first to fifth aspects, an attachment section having two faces with different orientations, the retainer being attached to the attachment section. The retainer has a third portion that is in contact with the two faces.

According to the aspect, the retainer has the third portion that is in contact with the two faces with different orientations of the attachment section. As described above, the retainer is in contact with the two faces of the attachment section, and attached to the attachment section. This can prevent such an event that the retainer is deformed due to external factors, such as a contact by a user, and the like.

In a printing apparatus according to a seventh aspect of the invention, in any one of the first to sixth aspects, the supporting unit is configured to be movable within a movement range, the movement range including a set position for the medium to be set. The retainer is attached to an end portion on a side of the set position of the printing apparatus in a movement direction of the supporting unit.

According to the aspect, the retainer is attached to the end portion on the side of the set position of the printing apparatus in the movement direction of the supporting unit, and the retainer allows the pressing unit to be retained near the side of the set position for a medium to easily set the medium.

A pressing unit retaining method according to an eighth aspect of the invention for a printing apparatus including a printing unit configured to perform printing onto a medium, a supporting unit configured to support the medium to be printed by the printing unit, a pressing unit configured to be attachable and detachable with respect to the supporting unit and to be attached to the supporting unit to press the medium supported by the supporting unit, and a retainer having a first portion, and a second portion positioned closer to a leading end side than the first portion and above the first portion in a vertical direction, the pressing unit retaining method including placing the pressing unit on the first portion, the pressing unit being detached from the supporting unit, to retain the pressing unit.

According to the aspect, the retainer is allowed to retain the pressing unit, where the retainer allows the pressing unit to be placed on the first portion, and prevents, by the second portion, the pressing unit from being detached from the retainer. Thus, the pressing unit is appropriately retained (the pressing unit is prevented from falling off and from being lost, for example).

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus 1 according to an example of the invention will be described in detail with reference to the appended drawings.

Example 1

FIGS. 1 to 16

Figure 1:
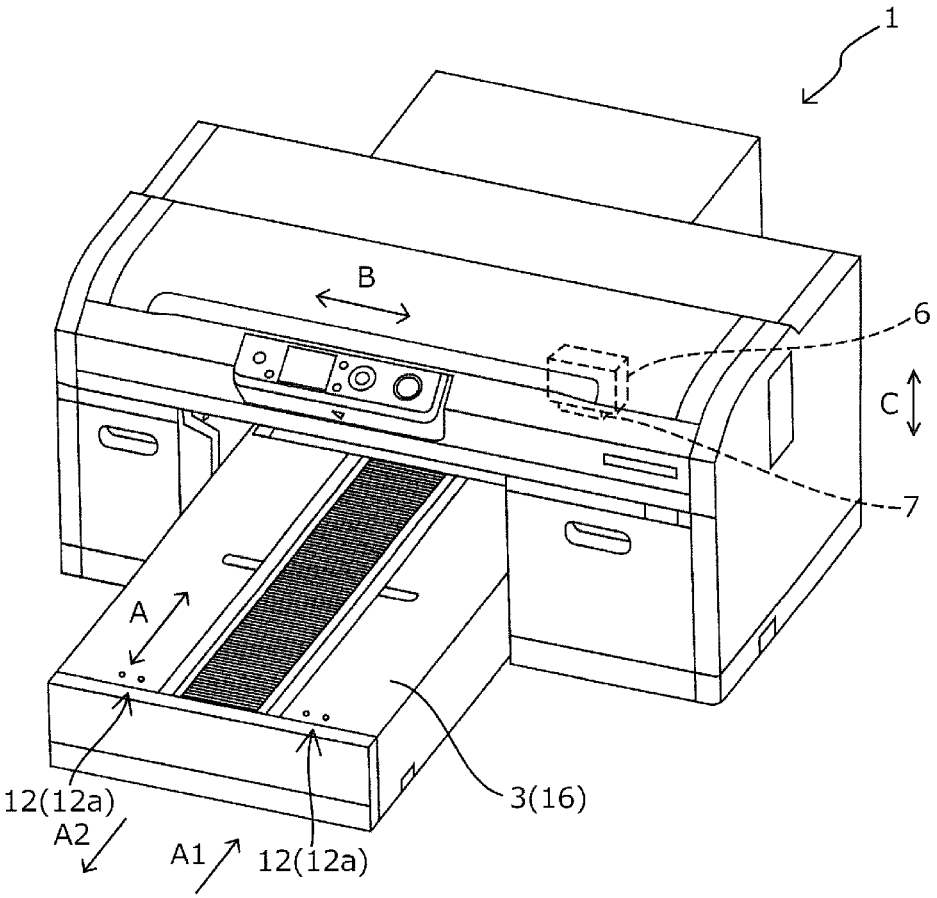
FIG. 1 is a schematic perspective view illustrating a printing apparatus according to Example 1 of the invention.
Figure 2:
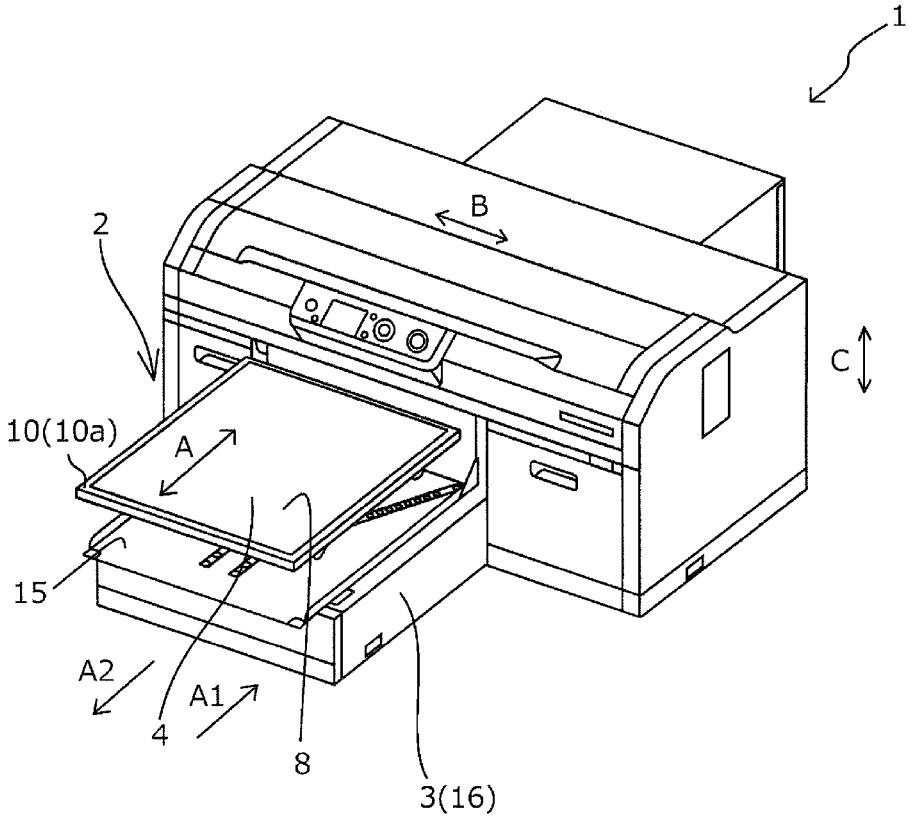
FIG. 2 is a schematic perspective view illustrating the printing apparatus according to Example 1 of the invention.
Figure 3:
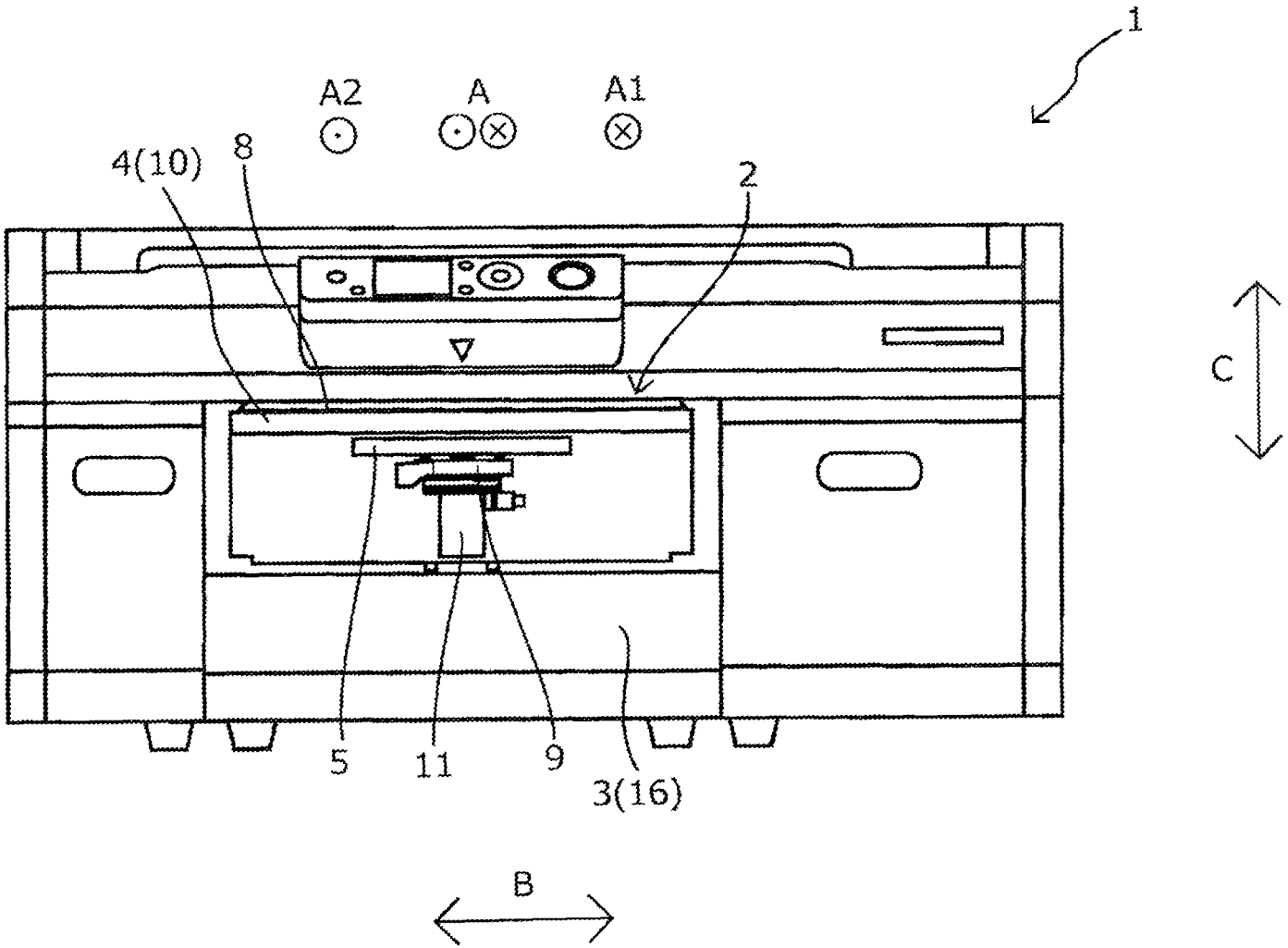
FIG. 3 is a schematic front view illustrating the printing apparatus according to Example 1 of the invention.
Figure 4:
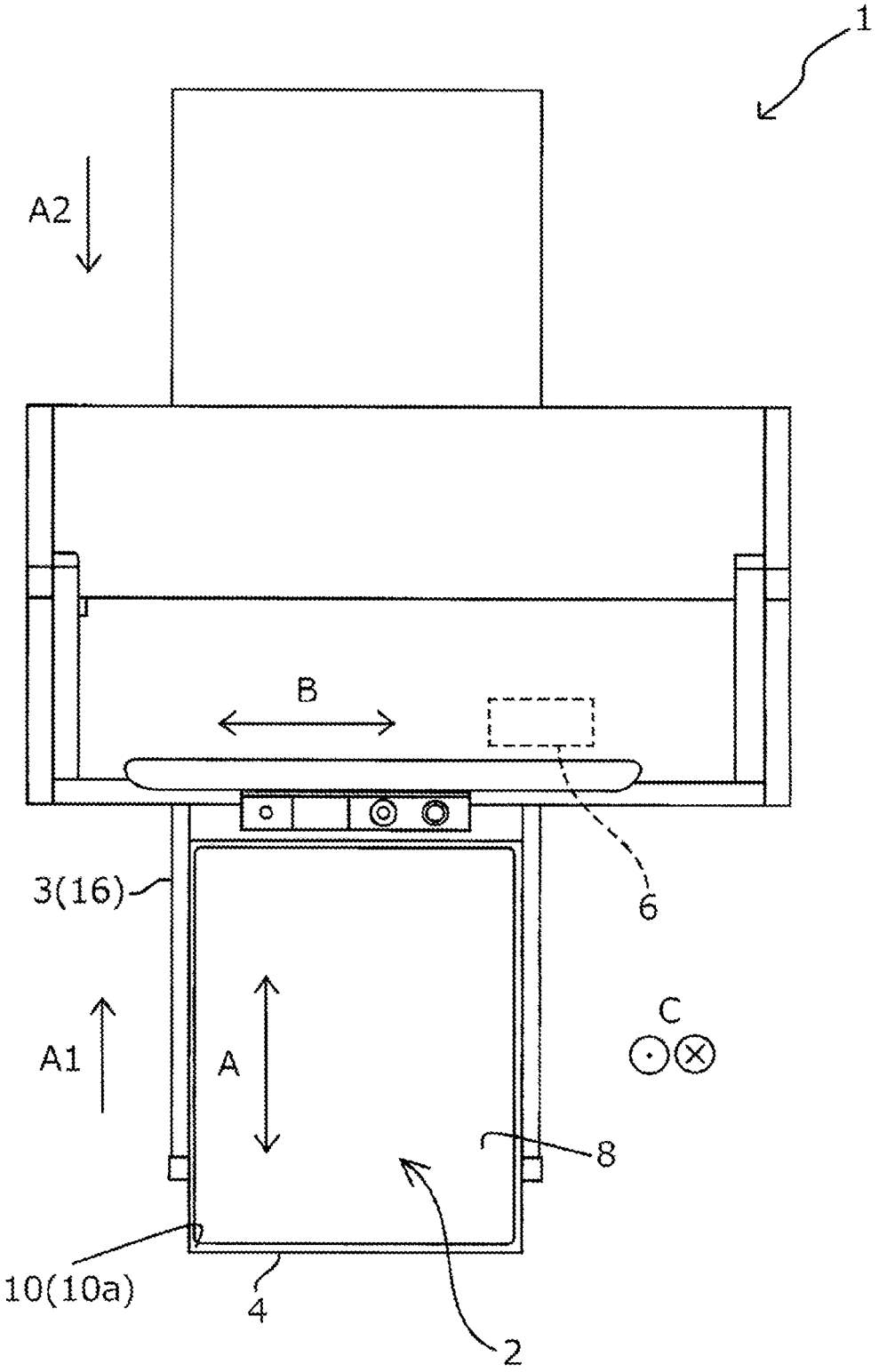
FIG. 4 is a schematic plan view illustrating the printing apparatus according to Example 1 of the invention.

FIG. 1 is a schematic perspective view illustrating the printing apparatus 1 according to the example, and illustrating a state where a medium supporting unit 2 serving as a supporting unit is at a printing start position. FIG. 2 is a schematic perspective view illustrating the printing apparatus 1 according to the example, and illustrating a state where the medium supporting unit 2 is at a set position for medium. FIG. 3 is a schematic front view illustrating the printing apparatus 1 according to the example. FIG. 4 is a schematic plan view illustrating the printing apparatus 1 according to the example, and illustrating a state where the medium supporting unit 2 is at the set position for medium. FIGS. 1 to 4 all illustrate states where retainers 13 configuring a main part of the printing apparatus 1 according to the example are detached, and some component elements are simplified. The printing start position denotes a start position of the medium supporting unit 2 when printing onto a medium starts. The set position denotes a stop position of the medium supporting unit 2 when the medium is to be set to the medium supporting unit 2.

The printing apparatus 1 according to the example includes the medium supporting unit 2 serving as a supporting unit. The medium supporting unit 2 includes a tray 4. The tray 4 has a supporting plane 8 configured to support a medium. The medium supporting unit 2 allows the supporting plane 8 of the tray 4 to support the medium, allows a frame 10 serving as a pressing unit to press the medium supported by the tray 4, and moves in a movement direction A.

The printing apparatus 1 also includes a medium transporting section 3 configured to transport the medium supported by the tray 4 in the movement direction A. The movement direction A is a direction including a direction A1, and a direction A2 opposite to the direction A1.

The tray 4 is detachably placed on a stage 5. Here, an attachment/detachment direction C of the tray 4 with respect to the stage 5 corresponds to a vertical direction for the printing apparatus 1 according to the example. Rotating a lever 9 causes the tray 4 to move in a direction along the attachment/detachment direction C (vertical direction) together with the stage 5. As illustrated in FIG. 3, the lever 9 is provided on an arm member 11. A variety of materials can be used as the medium, including textiles (fabric, cloth, and the like), paper, vinyl chloride resin, and the like.

The printing apparatus 1 includes, in its interior, a printing head 7 serving as a printing unit configured to allow a nozzle (not illustrated) to discharge ink to perform printing onto a medium (to form an image). The printing apparatus 1 according to the example causes a carriage 6 that retains the printing head 7 to move back and forth in a scanning direction B that intersects with the movement direction A. The printing apparatus 1 forms a desired image by discharging ink from the printing head 7 onto the medium supported by the tray 4 while causing the printing head 7 to move back and forth in the scanning direction B.

Note that, in the printing apparatus 1 according to the example, a front side (lower-left direction) in FIG. 1 corresponds to the set position for a medium onto the tray 4 (see FIGS. 2 and 4). The tray 4 on which the medium is set is moved in the direction A1 of the movement direction A until the tray 4 reaches a discharging start position on a rear side (upper-right direction) in FIG. 1. Printing is then carried out while the tray 4 is moved in the direction A2 of the movement direction A.

As illustrated in FIG. 1, the printing apparatus 1 according to the example includes, at a front side portion of the medium transporting section 3 (i.e., a front side portion of a housing unit 16), attachment sections 12 (attachment sections 12*a*). The attachment sections 12 are configured to allow the retainers 13 (see FIGS. 5 to 16) to be attached to the attachment sections 12. The retainers 13 are configured to retain the frame 10 that is detached from the medium supporting unit 2 (tray 4).

The attachment section 12 and the retainer 13 will now be described herein.

Figure 5:
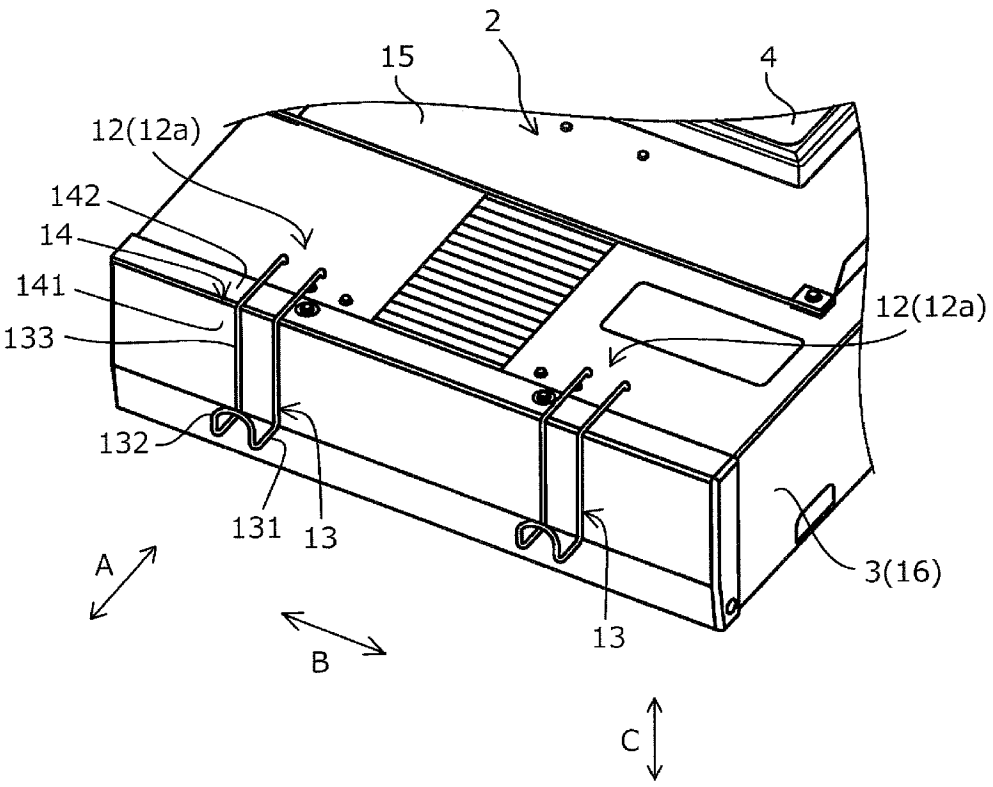
FIG. 5 is a schematic perspective view illustrating a main part of the printing apparatus according to Example 1 of the invention.
Figure 6:
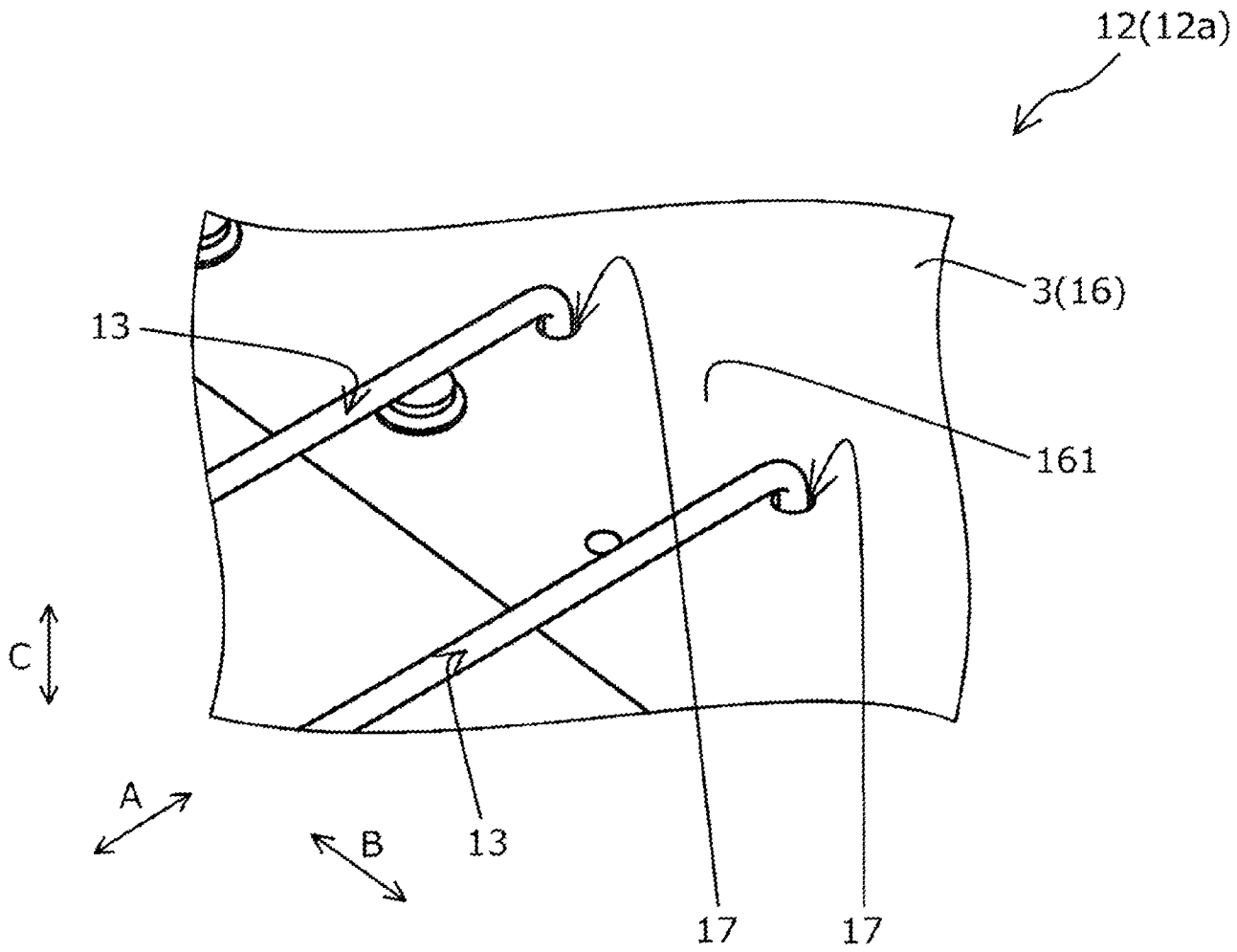
FIG. 6 is a schematic perspective enlarged view illustrating the main part of the printing apparatus according to Example 1 of the invention.

FIG. 5 is a schematic perspective view illustrating an area around the attachment sections 12*a* at which the retainers 13 that is the main part of the printing apparatus 1 according to the example are attached. FIG. 6 is a schematic perspective enlarged view illustrating the attachment section 12*a* at which the retainer 13 according to the example is attached.

Figure 7:
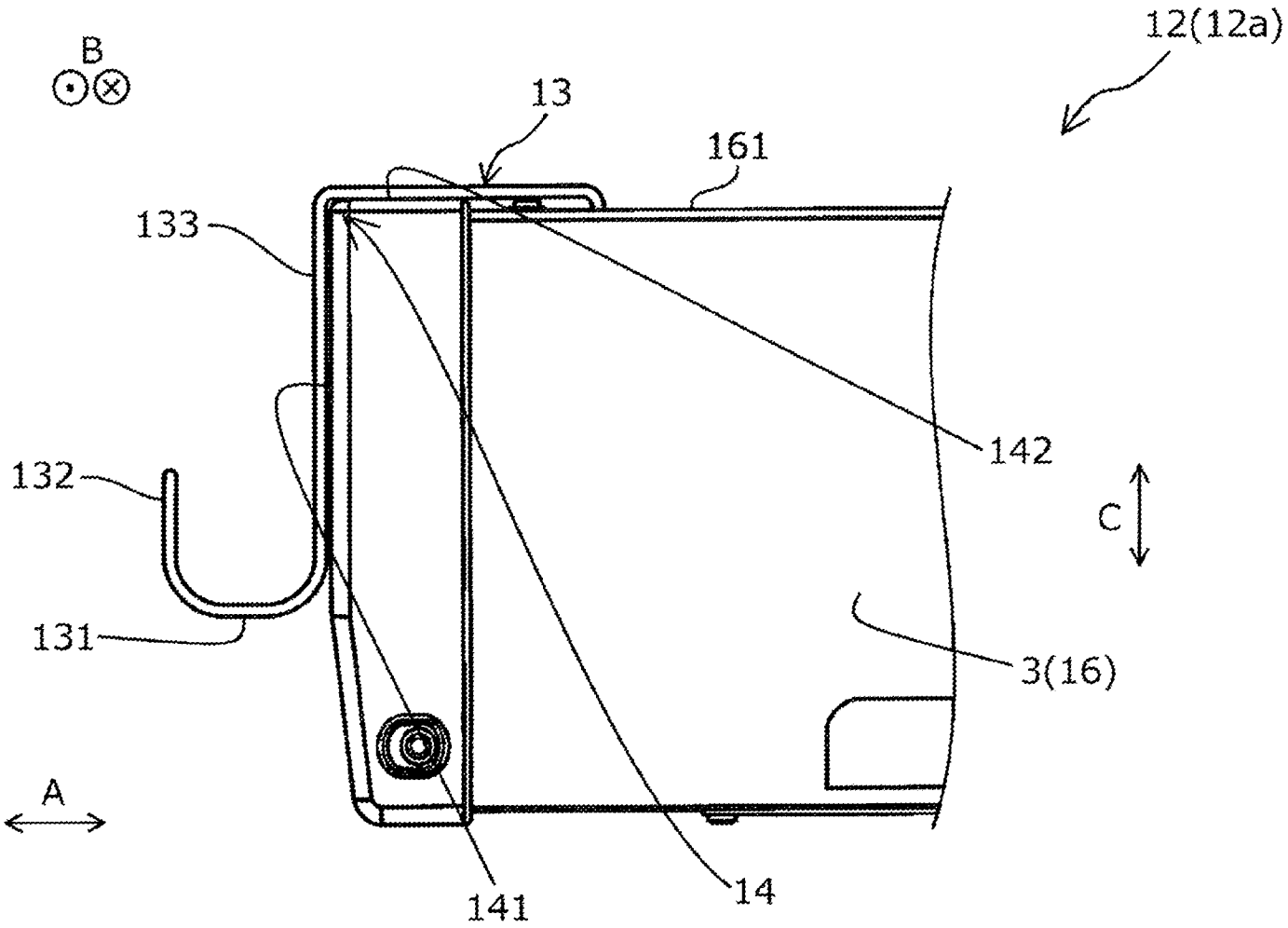
FIG. 7 is a schematic side view illustrating the main part of the printing apparatus according to Example 1 of the invention.
Figure 8:
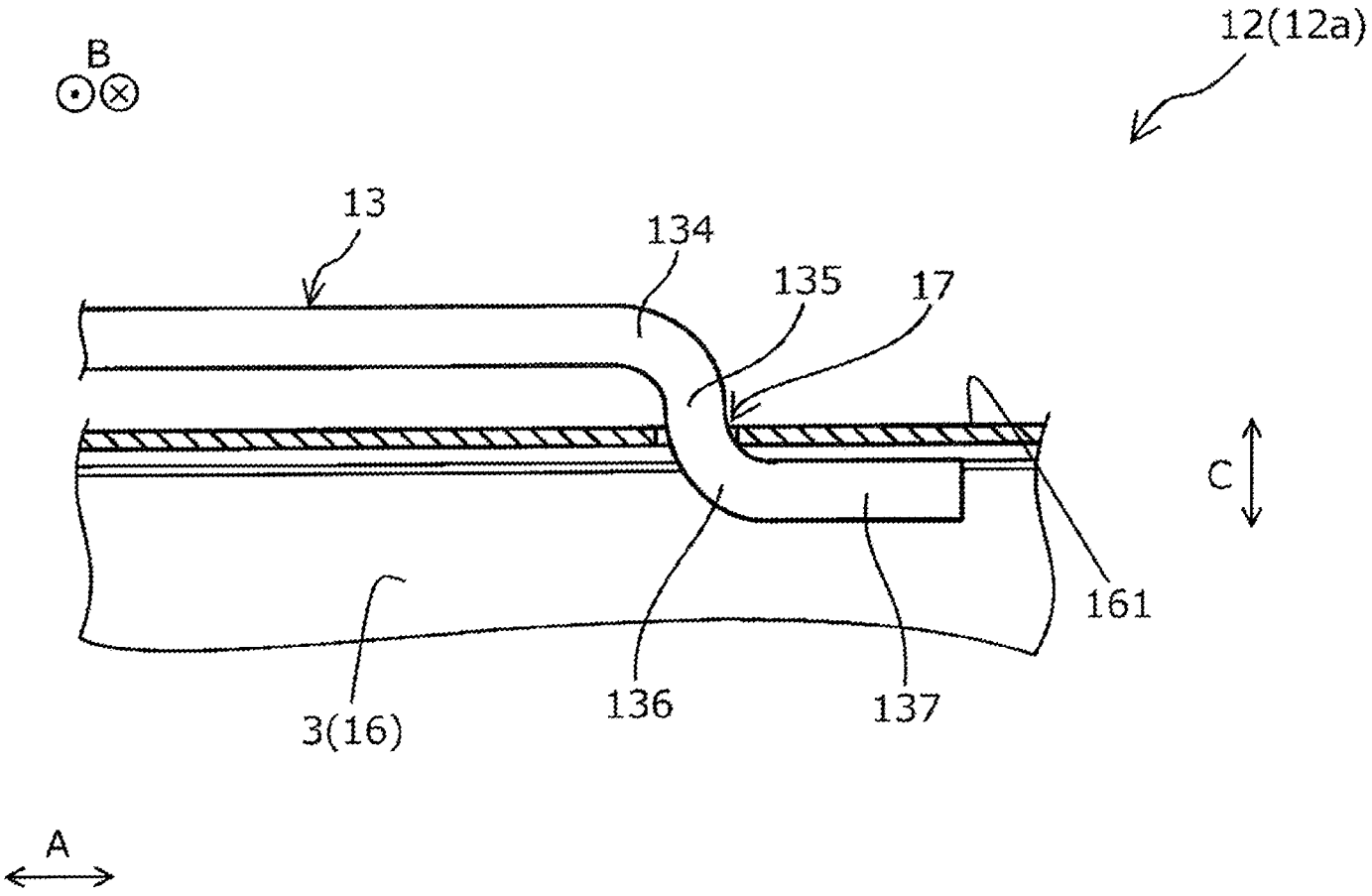
FIG. 8 is a schematic side cross-sectional diagram illustrating the main part of the printing apparatus according to Example 1 of the invention.

FIG. 7 is a schematic side view illustrating the area around the attachment section 12*a* at which the retainer 13 on the printing apparatus 1 according to the example is attached. FIG. 8 is a schematic side cross-sectional diagram illustrating the attachment section 12*a* at which the retainer 13 according to the example is attached.

Figure 9:
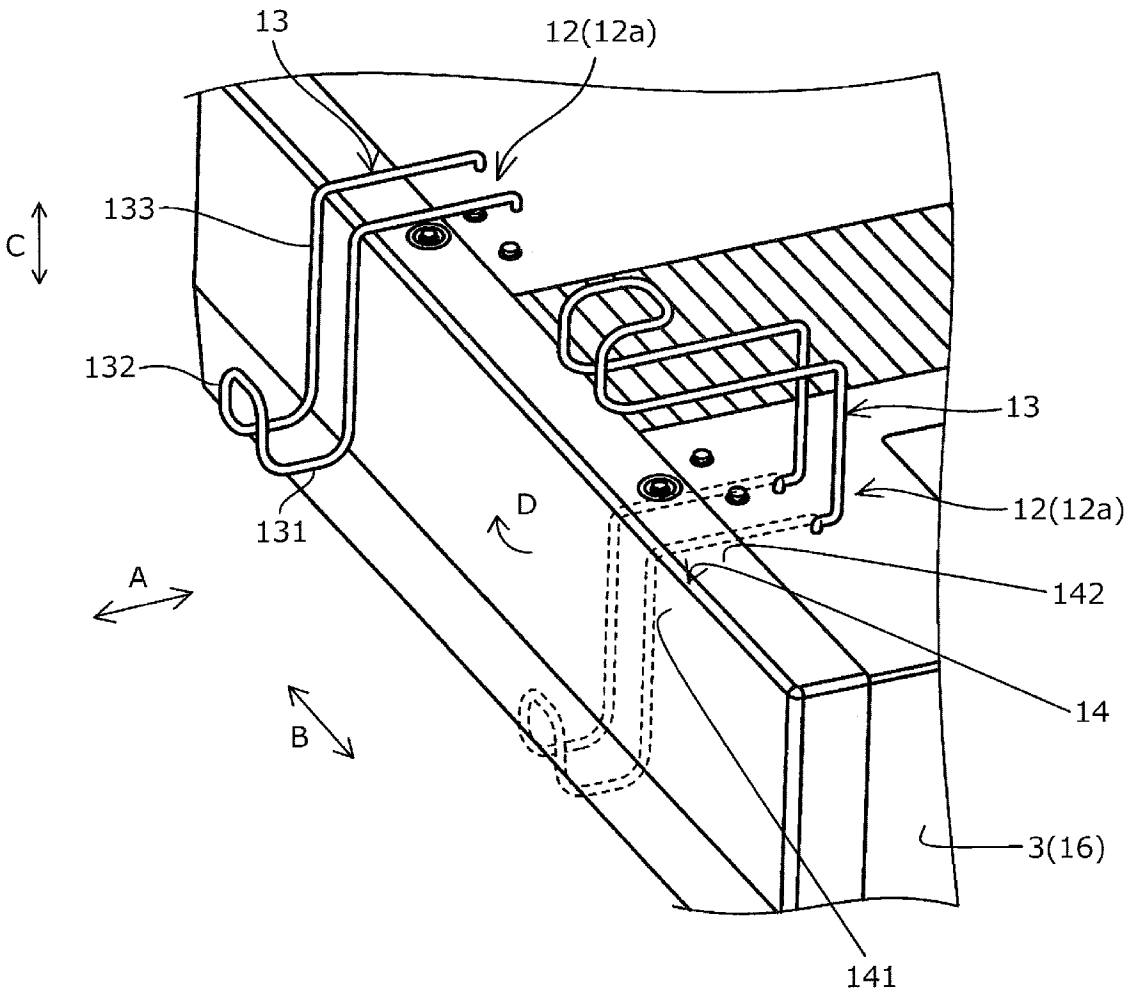
FIG. 9 is a schematic perspective view illustrating the main part of the printing apparatus according to Example 1 of the invention.

FIG. 9 is a schematic perspective view illustrating the area around the attachment sections 12*a* at which the retainers 13 according to the example are attached, and illustrating a state when the retainers 13 are attached and detached.

Figure 10:
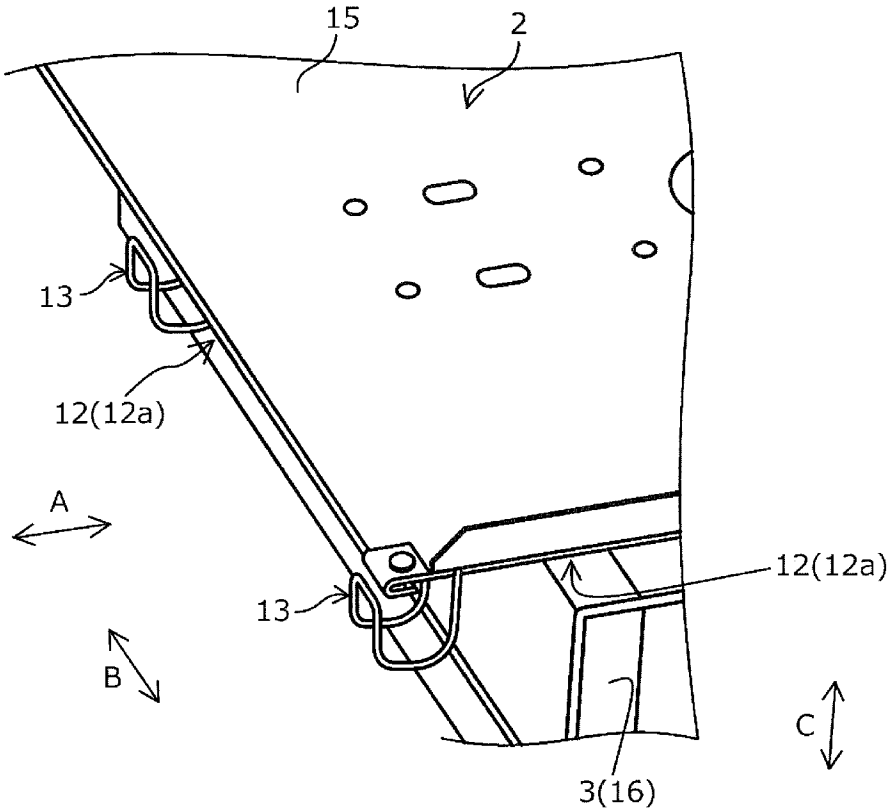
FIG. 10 is a schematic perspective view illustrating the main part of the printing apparatus according to Example 1 of the invention.
Figure 11:
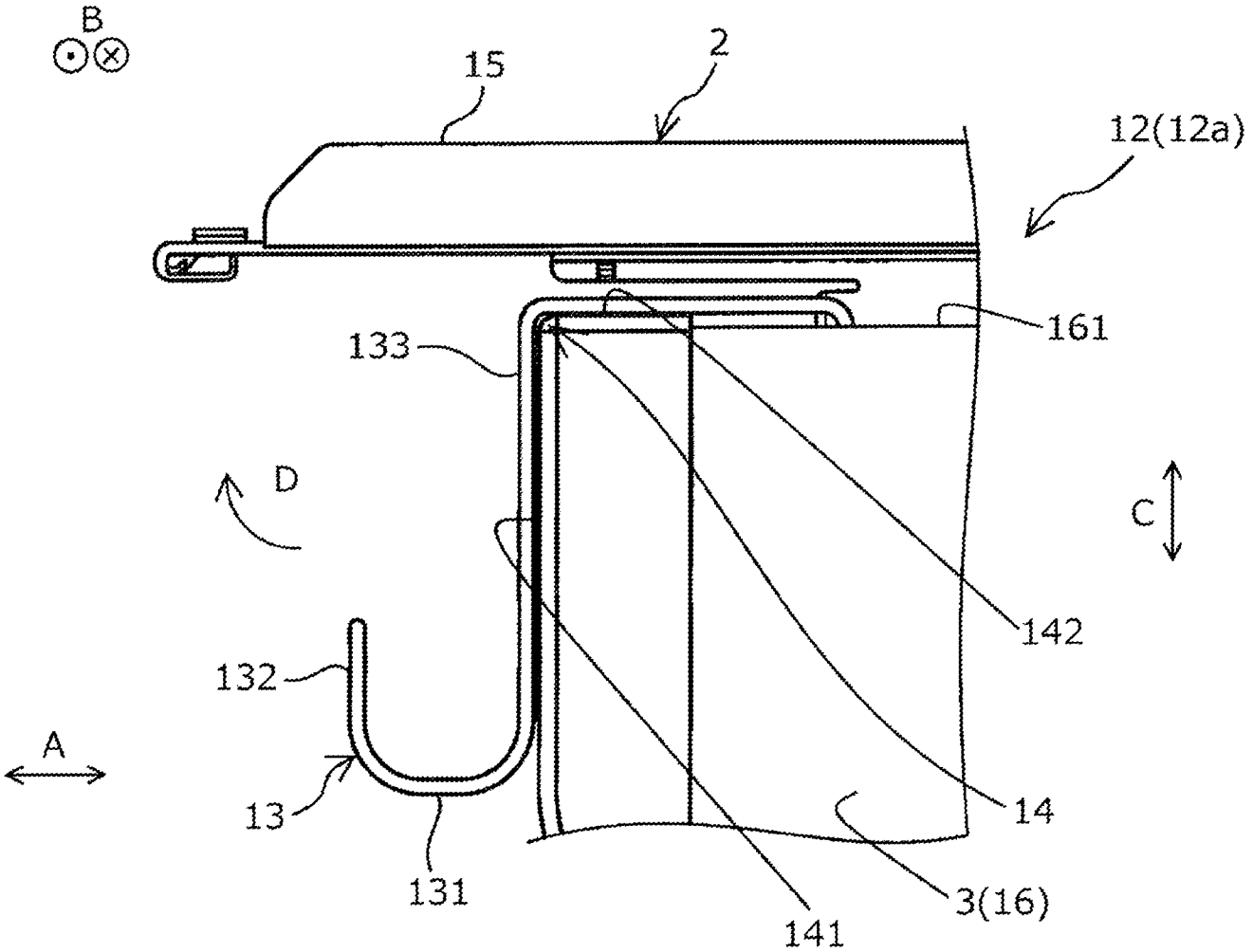
FIG. 11 is a schematic side view illustrating the main part of the printing apparatus according to Example 1 of the invention.

FIG. 10 is a schematic perspective view illustrating the area around the attachment sections 12*a* at which the retainers 13 according to the example are attached, and illustrating a state where the medium supporting unit 2 is positioned at the set position. FIG. 11 is a schematic side view illustrating the area around the attachment section 12*a* at which the retainer 13 according to the example is attached, and illustrating a state where the medium supporting unit 2 is positioned at the set position.

Figure 12:
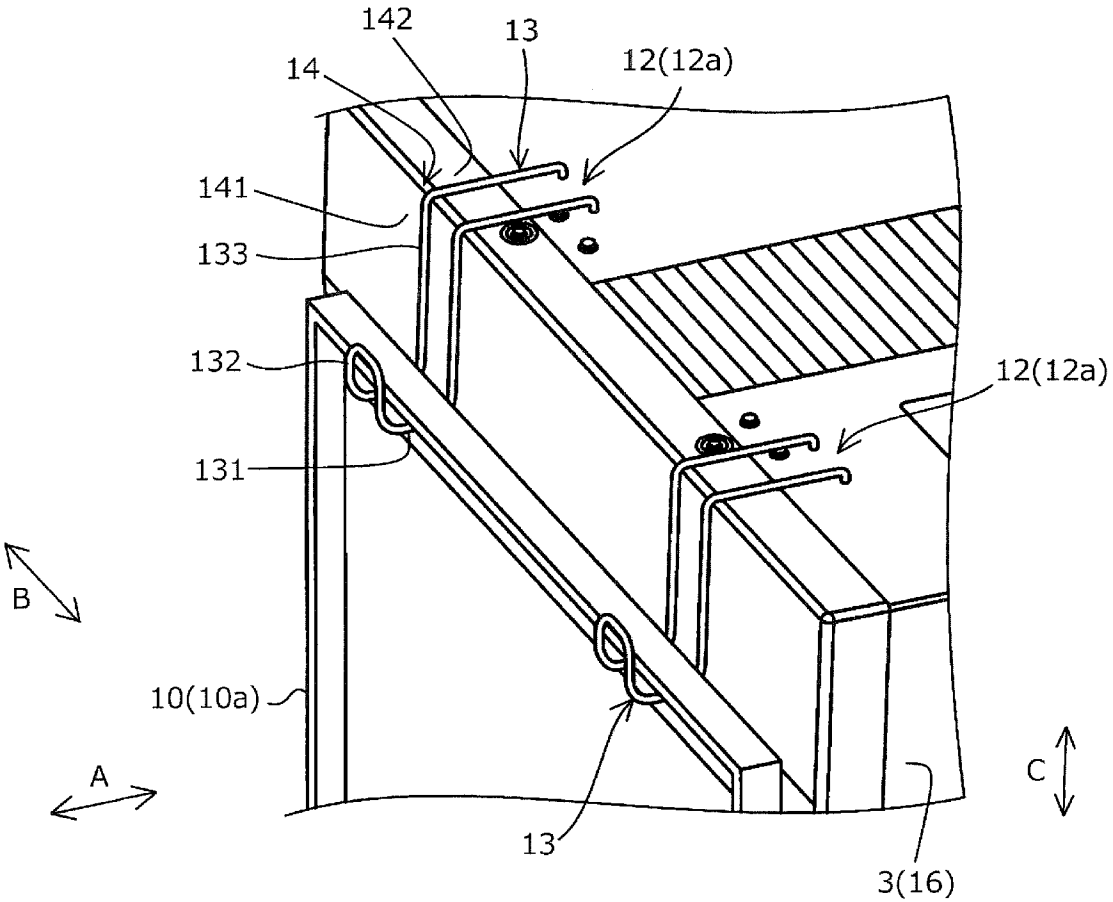
FIG. 12 is a schematic perspective view illustrating the main part of the printing apparatus according to Example 1 of the invention.
Figure 13:
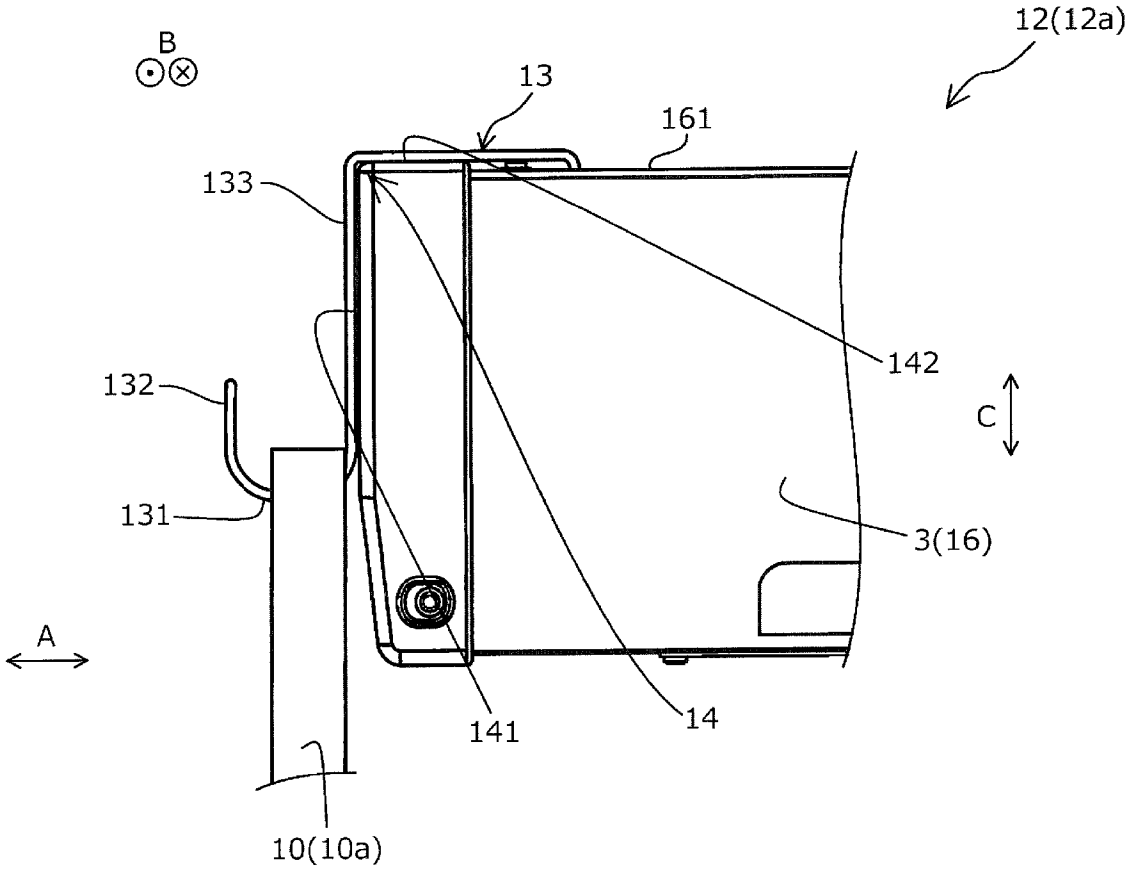
FIG. 13 is a schematic side view illustrating the main part of the printing apparatus according to Example 1 of the invention.
Figure 14:
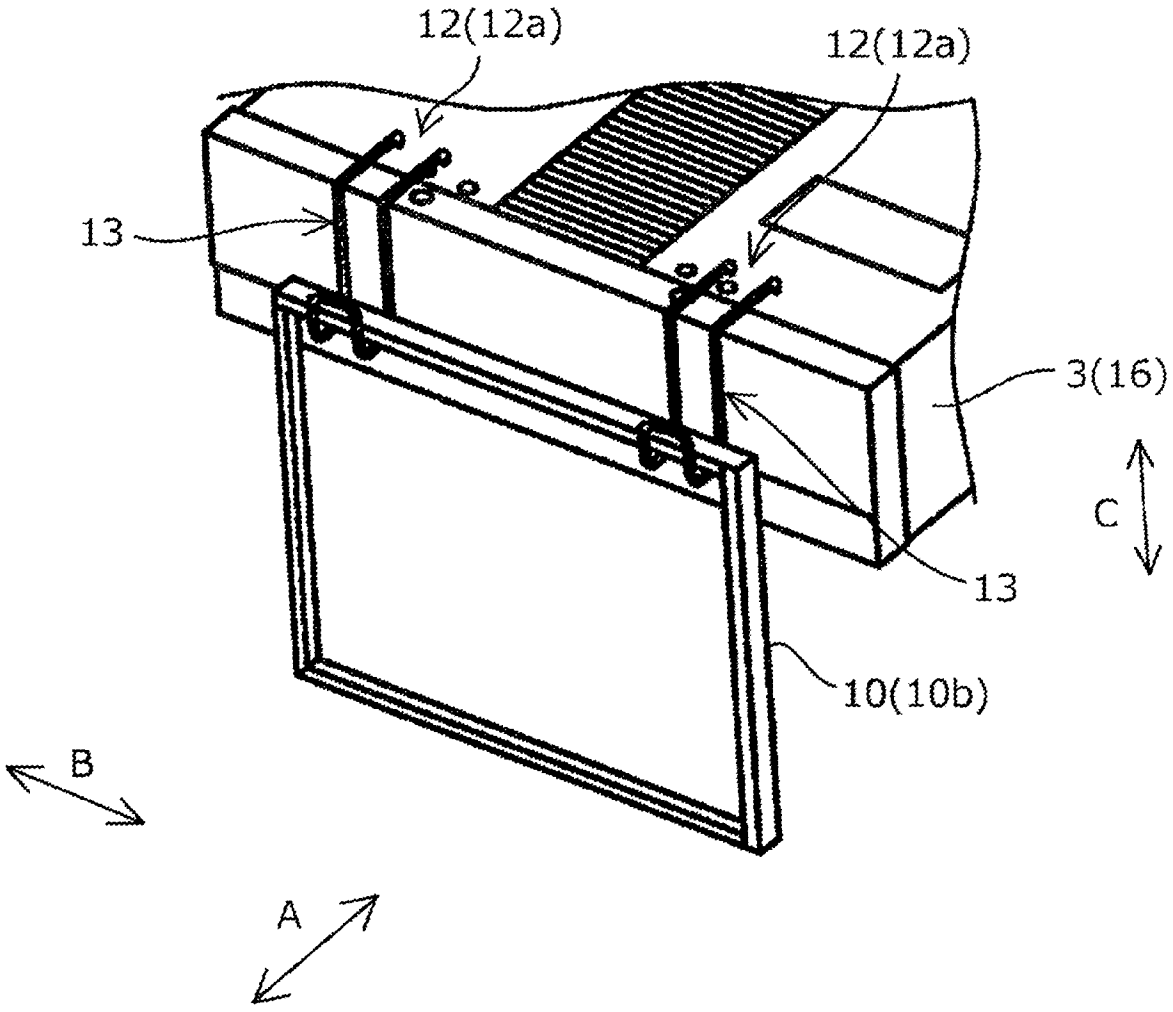
FIG. 14 is a schematic perspective view illustrating the main part of the printing apparatus according to Example 1 of the invention.
Figure 15:
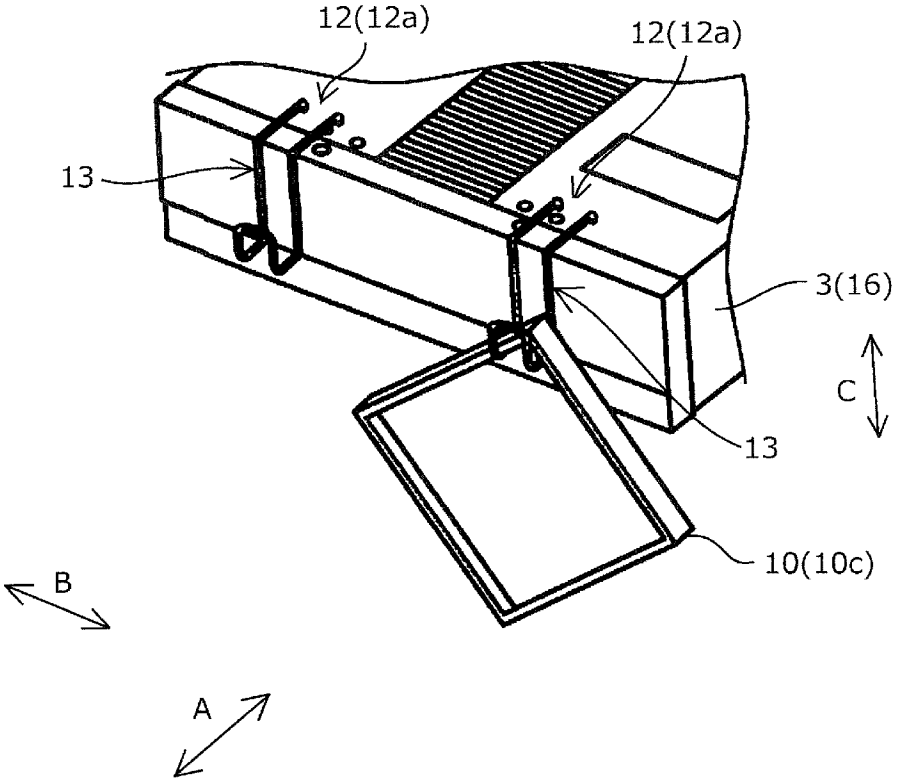
FIG. 15 is a schematic perspective view illustrating the main part of the printing apparatus according to Example 1 of the invention.
Figure 16:
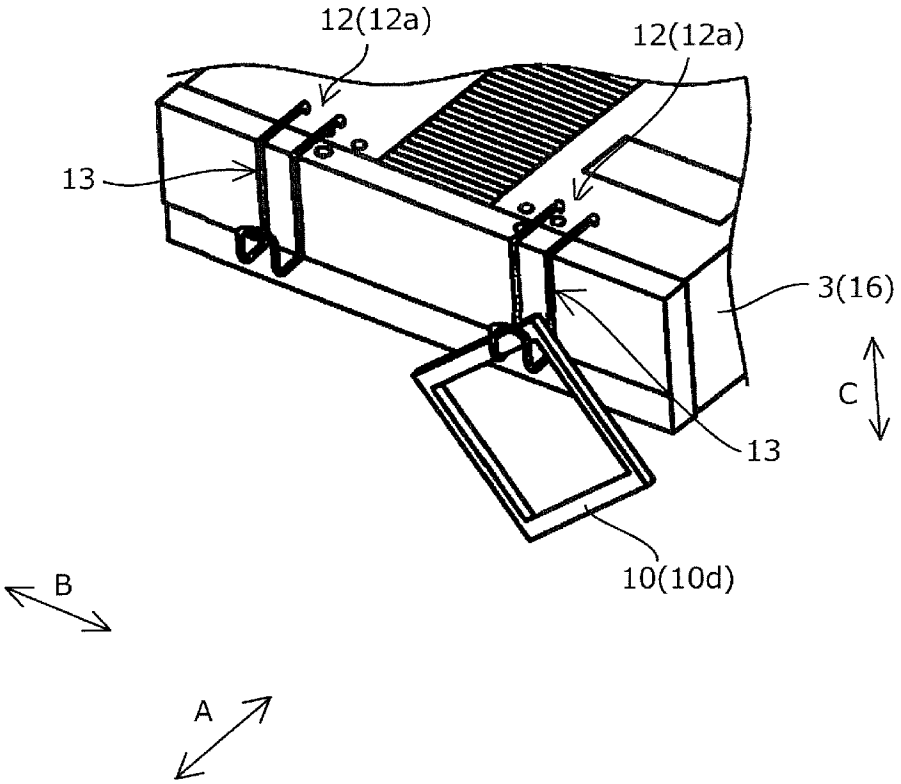
FIG. 16 is a schematic perspective view illustrating the main part of the printing apparatus according to Example 1 of the invention.

FIG. 12 is a schematic perspective view illustrating the area around the attachment sections 12*a* according to the example, where a frame 10*a* is retained by the retainers 13. FIG. 13 is a schematic side view illustrating the area around the attachment sections 12 according to the example, where the frame 10*a* is retained by the retainer 13. FIG. 14 is a schematic perspective view illustrating the area around the attachment sections 12*a* according to the example, where a frame 10*b* is retained by the retainers 13. FIG. 15 is a schematic perspective view illustrating the area around the attachment sections 12*a* according to the example, when a frame 10*c* is retained by one of the retainers 13. FIG. 16 is a schematic perspective view illustrating the area around the attachment sections 12*a* according to the example, when a frame 10*d* is retained by one of the retainers 13.

As illustrated in FIGS. 5 to 16, the printing apparatus 1 according to the example includes the attachment sections 12 (attachment sections 12*a*) on the housing unit 16 at a position of the medium transporting section 3. The retainers 13 are configured to be attached to the attachment sections 12.

As illustrated in FIGS. 7, 11, and 13, for example, the retainer 13 has a first portion 131, a second portion 132 formed positioned closer to a leading end of the retainers 13 than the first portion 131 and above the first portion 131 in the vertical direction, and a third portion 133 positioned closer to a trailing end of the retainers 13 than the first portion 131 and above the first portion 131 in the vertical direction.

Here, the term "leading end side" denotes an opposite side to a side on which the retainer 13 is to be attached to the printing apparatus 1. The term "trailing end side" denotes a side on which the retainer 13 is to be attached to the printing apparatus 1.

By summarizing the above description in here, the printing apparatus 1 according to the example includes the printing head 7 configured to perform printing onto a medium, the medium supporting unit 2 configured to support the medium to be printed by the printing head 7, the frame 10 configured to be attachable and detachable with respect to the medium supporting unit 2 and to be attached to the medium supporting unit 2 to press the medium supported by the medium supporting unit 2, and the retainer 13 configured to retain the frame 10 that is detached from the medium supporting unit 2.

As illustrated in FIG. 13, for example, the retainer 13 has the first portion 131 on which the frame 10 is to be placed, and the second portion 132 positioned closer to the leading end of the retainer 13 than the first portion 131 and above the first portion 131 in the vertical direction.

The printing apparatus 1 according to the example is configured to allow the retainer 13 to retain the frame 10, where the retainer 13 allows the frame 10 to be placed on the first portion 131 and to prevent, by the second portions 132, the frame 10 from being detached from the retainer 13 to appropriately retain the frame 10 (the frame 10 is prevented from falling off and from being lost, for example).

In other words, with the printing apparatus 1, according to the example including the printing head 7 configured to perform printing onto a medium, the medium supporting unit 2 configured to support the medium to be printed by the printing head 7, the frame 10 configured to be attachable and detachable with respect to the medium supporting unit 2 and to be attached to the medium supporting unit 2 to press the medium supported by the medium supporting unit 2, and the retainer 13 having the first portion 131, and the second portion 132 positioned closer to the leading end than the first portion 131 and above the first portion 131 in the vertical direction, a pressing unit retaining method including retaining the frame 10 that is detached from the medium supporting unit 2, and placed on the first portion 131 is executed.

Executing such a pressing unit retaining method allows the retainer 13 to retain the frame 10, where the retainer 13 allows the frame 10 to be placed on the first portion 131, and prevents, by the second portions 132, the frame 10 from being detached from the retainer 13 to appropriately retain the frame 10 (the frame 10 is prevented from falling off and from being lost, for example).

As illustrated in FIGS. 5, 7, 9, and 11 to 13, for example, the printing apparatus 1 according to the example includes, at the attachment sections 12 (attachment sections 12*a*) of the housing unit 16, a bent portion 14 having adjacent two faces (a face 141 and a face 142). As illustrated in FIGS. 7, 11, and 13, the retainer 13 has the third portion 133 that is to be in contact with the two (a plurality of) faces 141 and 142 with different orientations. Thus, the printing apparatus 1 according to the example is configured to allow the retainer 13 to be in contact with the two faces 141 and 142 with different orientations, and to be attached to the attachment sections 12, and prevents such an event that the retainer 13 is deformed due to external factors, such as a contact by a user, and the like.

Here, the term "being in contact with the two faces with different orientations" denotes the term "being in contact with at least two faces", and may denote the term "being in contact with three or more faces".

As described above, the medium supporting unit 2 according to the example is configured to be movable within a movable range, and the movable range includes the set position for a medium to be set. As illustrated in FIGS. 5, 7, 9 to 16, the retainer 13 according to the example is attached to an end portion on a side of the set position of the printing apparatus 1 in the movement direction A of the medium supporting unit 2. This allows the printing apparatus 1 according to the example to retain the frame 10 near the set position for a medium, and allows the frame 10 to press the medium immediately after the medium is set to the tray 4 thus making medium setting easy.

The printing apparatus 1 according to the example is configured to use one of a plurality of trays 4 with different sizes in accordance with a size of a medium to be used. The printing apparatus 1 is configured to use a plurality of frames 10 with different sizes (the frame 10*a*, the frame 10*b*, the frame 10*c*, and the frame 10*d*) in accordance with the plurality of trays 4 with different sizes. The plurality of frames 10 each have rectangular shapes each having two longer sides and two shorter sides. At this time, the printing apparatus 1 is configured to use one type of tray 4 and frame 10 at a time, and configured to allow a user to select and use one of the plurality of trays 4 with different sizes and one of the plurality of frames 10 with different sizes. That is, the printing apparatus 1 is configured to allow a tray 4 to be replaced with another tray 4 of the plurality of trays 4 with different sizes, and configured to allow a frame 10 to be replaced with another frame 10 of the plurality of frames 10 with different sizes.

As illustrated in FIGS. 5, 9, 10, 12, 14 to 16, the printing apparatus 1 according to the example includes a plurality of (two) retainers 13.

As described above, the printing apparatus 1 according to the example includes the plurality of retainers 13, and is configured to allow the plurality of retainers 13 to particularly securely retain the frame 10 (see FIGS. 12 and 14). In a configuration where a tray 4 is replaceable with another tray 4 of the plurality of the trays 4 with different sizes and a frame 10 is replaceable with another frame 10 of the plurality of the frames 10 with different sizes, the printing apparatus 1 is configured to allow the plurality of retainers 13 to support the plurality of frames 10 with different sizes (see FIGS. 12 to 16).

FIGS. 12 and 13 illustrate states where a largest frame, i.e., the frame 10*a*, among the plurality of frames 10 that can be used in the printing apparatus 1 according to the example, is retained. At this time, the frame 10*a* is retained by the plurality of retainers 13, where a shorter side of the frame 10*a* is placed across the plurality of retainers 13. FIG. 14 illustrates a state where a second larger frame, i.e., the frame 10*b*, among the plurality of the frames 10 that can be used in the printing apparatus 1 according to the example, is retained. At this time, the frame 10*b* is retained by the plurality of retainers 13, where a longer side of the frame 10*b* is placed across the plurality of retainers 13. FIG. 15 illustrates a state where a third larger frame, i.e., the frame 10*c*, among the plurality of the frames 10 that can be used in the printing apparatus 1 according to the example, is retained. At this time, the frame 10*c* is retained by one of the plurality of retainers 13, where a corner of the frame 10*c* is hooked by one of the plurality of retainers 13. FIG. 16 illustrates a state where a smallest frame, i.e., the frame 10*d*, among the plurality of the frames 10 that can be used in the printing apparatus 1 according to the example, is retained. At this time, the frame 10*d* is retained by one of the plurality of retainers 13, where a corner of the frame 10*d* is hooked by one of the plurality of retainers 13.

As described above, depending on a size of the frame 10, there is a case where the plurality of retainers 13 are used to retain the frame 10, or a case where one of the plurality of retainers 13 is used to retain the frame 10. Which part of the frame 10 is to be placed on the retainer 13 differs depending on a size of the frame 10. In any cases, the frame 10 may be retained by the retainer 13 in a posture that allows the frame 10 to be stably retained.

As illustrated in FIGS. 6 and 8, the attachment section 12*a* according to the example includes a round hole 17 on the housing unit 16. As illustrated in FIG. 8, the retainer 13 according to the example has, on the trailing end side, a bent portion 134, a straight portion 135, a bent portion 136, and a trailing end portion 137 that is straight. With the attachment section 12*a* and the retainer 13 configured as illustrated in FIG. 8, the printing apparatus 1 according to the example is configured to allow the trailing end of the retainer 13 to be inserted into the round hole 17, to allow the trailing end portion 137 of the retainer 13 to be in contact with (abut) a top face 161 of the housing unit 16, and to allow the retainer 13 to be attached to the housing unit 16 (attachment sections 12*a*).

The retainer 13 is also detachable from the housing unit 16. When the retainer 13 is detached from the housing unit 16, the retainer 13 is moved (rotated) relative to the housing unit 16 in a direction D, and is pulled out upward, as illustrated in FIG. 9. The retainer 13 is thus detached from the housing unit 16.

As described above, the retainer 13 according to the example is configured to be detachable from the printing apparatus 1. The printing apparatus 1 according to the example allows the retainer 13 to be easily detached when the retainer 13 is not to be used or is to be replaced, for example (see FIGS. 1 to 4).

The configuration of the retainer 13 and the configuration of the attachment section 12 at which the retainers 13 are attached are not limited to the above described configurations. For example, such a configuration may be applied that is different from a configuration where the retainer 13 is rotated relative to the housing unit 16 for attachment and detachment. Such a configuration may also be applied that the retainer 13 is configured not to be easily detached from the housing unit 16. The retainer 13 and the attachment section 12 at which the retainer 13 is attached are not limited to the configurations in shape, raw material, size, and the like, described in the above example.

However, in a configuration where the retainer 13 is freely detachable from the housing unit 16 in any state, the retainer 13 may unexpectedly be detached from the housing unit 16, and, a loss of the retainer 13 and the like may occur. In the printing apparatus 1 according to the example, when the medium supporting unit 2 is positioned at the set position, the retainer 13 is attached at a position allowing the medium supporting unit 2 to prevent the retainer 13 from being detached from the printing apparatus 1. Specifically, as illustrated in FIGS. 10 and 11, when the medium supporting unit 2 is positioned at the set position, a medium receiving unit 15 configured to receive a medium protruded from the tray 4 (see FIG. 2) prevents the retainer 13 from being moved in the direction D. This allows the printing apparatus 1 according to the example to prevent the retainer 13 from being detached unintentionally due to external factors and the like, such as a contact by a user when the user is setting a medium.

Other configuration examples may include, in which the retainer 13 is attached at a position, at which that allows the medium supporting unit 2 to prevent the retainer 13 from being detached from the printing apparatus 1, a configuration example where the retainer 13 may be fixed to the printing apparatus 1 with a pin, a screw, or the like, and the medium supporting unit 2 positioned at the set position may prevent the pin, the screw, or the like from being accessed. Specifically, it is a configuration, in which the pin or the screw is covered by the medium receiving unit 15 and the like when the medium supporting unit 2 is positioned at the set position. However, the above described configuration is not intended to result in limitation.

In the printing apparatus 1 according to the example, an attaching position for the retainer 13 on the printing apparatus 1 is predetermined. However, the above described configuration is not intended to result in limitation. The printing apparatus 1 may be configured to allow the attaching position for the retainer 13 on the printing apparatus 1 to be adjusted.

An example of the printing apparatus 1 configured to allow the attaching position for the retainer 13 to be adjusted in relation to the printing apparatus 1 will now be described herein.

Example 2

FIG. 17

Figure 17:
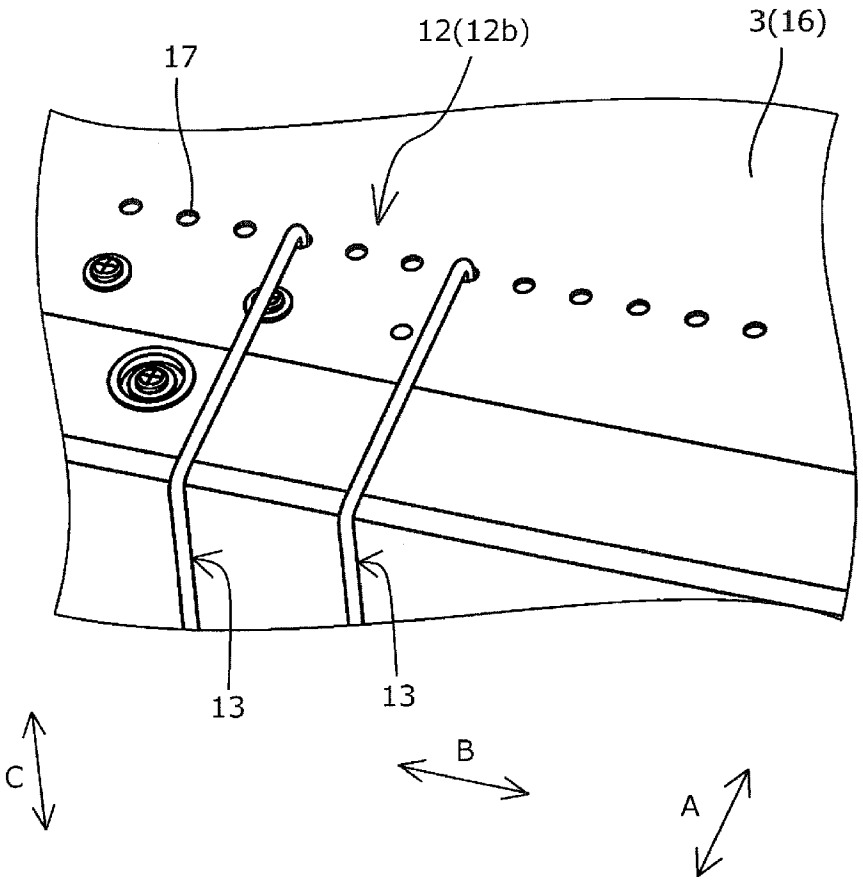
FIG. 17 is a schematic perspective enlarged view illustrating a main part of a printing apparatus according to Example 2 of the invention.

FIG. 17 is a schematic perspective view illustrating an area around attachment section 12 (attachment section 12*b*) of a printing apparatus 1 according to the example. Like numbers designate identical or corresponding component elements in Example 1, described above, and detailed description for such component elements are omitted.

The printing apparatus 1 according to the example 2 is configured in a similar manner to the printing apparatus 1 according to Example 1, excluding a configuration of the attachment section 12 (a plurality of round holes 17 are arranged along a scanning direction B).

As illustrated in FIG. 17, at the attachment section 12*b* of the printing apparatus 1 according to the example, the plurality of round holes 17 are formed along the scanning direction B. The printing apparatus 1 allows the retainer 13 to be disposed (attached) onto any hole 17 among the plurality of round holes 17 formed along the scanning direction B. With the configuration described above, two retainers 13 are configured to be respectively attached at any two positions in the scanning direction B. That is, a spacing between the two retainers 13 is adjustable to another spacing.

In other words, in the printing apparatus 1 according to the example, the spacing between the two retainers 13 is adjustable. In a configuration where a tray 4 is replaceable with another tray 4 of a plurality of trays 4 with different sizes and a frame 10 is replaceable with another frame 10 of a plurality of frames 10 with different sizes, the printing apparatus is allowed to support the plurality of frames 10 with different sizes by adjusting the spacing between the two retainers 13. Specifically, for example, the printing apparatus 1 allows the two retainers 13 to have a narrower spacing between the two retainers 13 to securely retain a smaller frame, such as the frame 10*c* and the frame 10*d*, as respectively illustrated in FIGS. 15 and 16.

Example 3

FIG. 18

Figure 18:
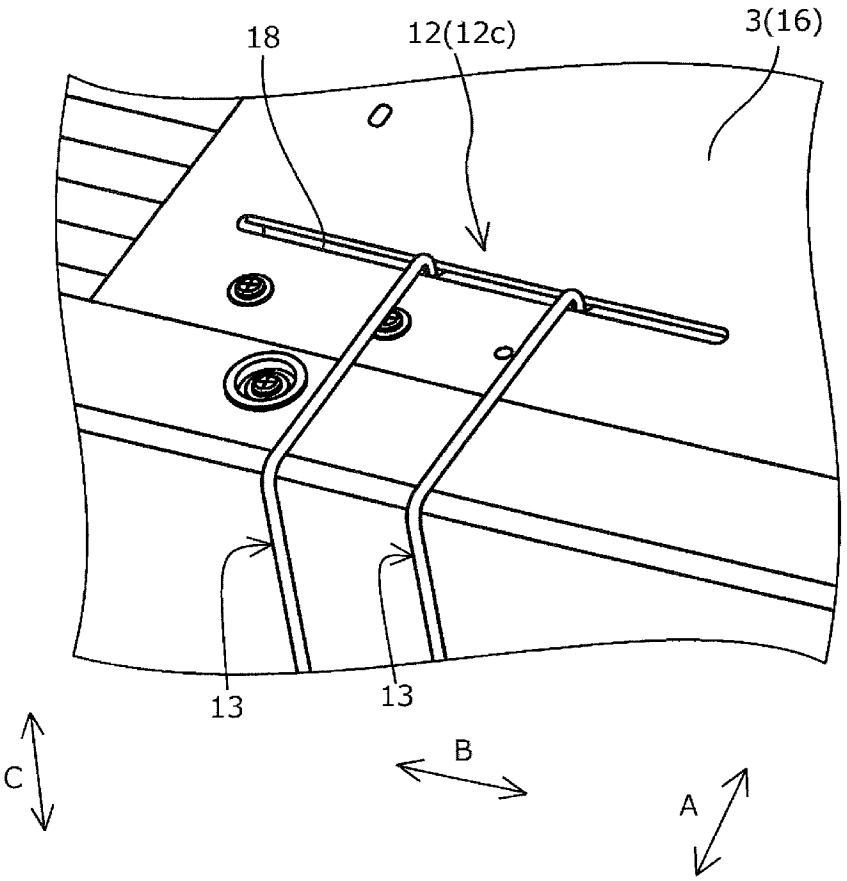
FIG. 18 is a schematic perspective enlarged view illustrating a main part of a printing apparatus according to Example 3 of the invention.

FIG. 18 is a schematic perspective view illustrating an area around attachment section 12 (attachment section 12*c*) of a printing apparatus 1 according to the example. Like numbers designate identical or corresponding component elements in the examples 1 and 2, described above, and detailed description for such component elements are omitted.

The printing apparatus 1 according to Example 3 is configured in a similar manner to the printing apparatuses 1 according to Examples 1 and 2, excluding a configuration of the attachment section 12 (instead of the round hole 17, a groove 18 is formed along a scanning direction B).

As illustrated in FIG. 18, at the attachment section 12*c* of the printing apparatus 1 according to the example, the groove 18 along the scanning direction B is formed. The printing apparatus 1 allows the retainer 13 to move along the groove 18 formed along the scanning direction B, and is configured to be disposed (attached) onto a position along the scanning direction B. With the configuration described above, the two retainers 13 can be moved to any two positions along the scanning direction B. That is, a spacing between the two retainers 13 is adjustable to another spacing.

In other words, the printing apparatus 1 according to the example is also configured to adjust the spacing between the two retainers 13, similar to the printing apparatus 1 according to Example 2. In a configuration where a tray 4 is replaceable with another tray 4 of a plurality of trays 4 with different sizes and a frame 10 is replaceable with another frame 10 of a plurality of frames 10 with different sizes, the printing apparatus 1 is allowed to support the plurality of frames 10 with different sizes by adjusting the spacing between the two retainers 13. Specifically, for example, the printing apparatus 1 allows the two retainers 13 to have a narrower spacing between the two retainers 13 to securely retain a smaller frame, such as the frame 10*c* and the frame 10*d*, as respectively illustrated in FIGS. 15 and 16.

The printing apparatuses 1 according Examples 1 to 3, as described above, are configured to allow the plurality of retainers 13 to be attached to the end portion on the side of the set position of each of the printing apparatuses 1 in the movement direction A of the medium supporting unit 2. However, the above described configuration example is not intended to result in limitation. In still another configuration, the plurality of retainers 13 may be attached at different attaching positions on the printing apparatuses 1.

An example where attaching positions for a plurality of retainers 13 on a printing apparatus 1 differ from the attaching positions on the printing apparatuses 1 according to Examples 1 to 3 as described above will now be described herein.

Example 4

FIG. 19

Figure 19:
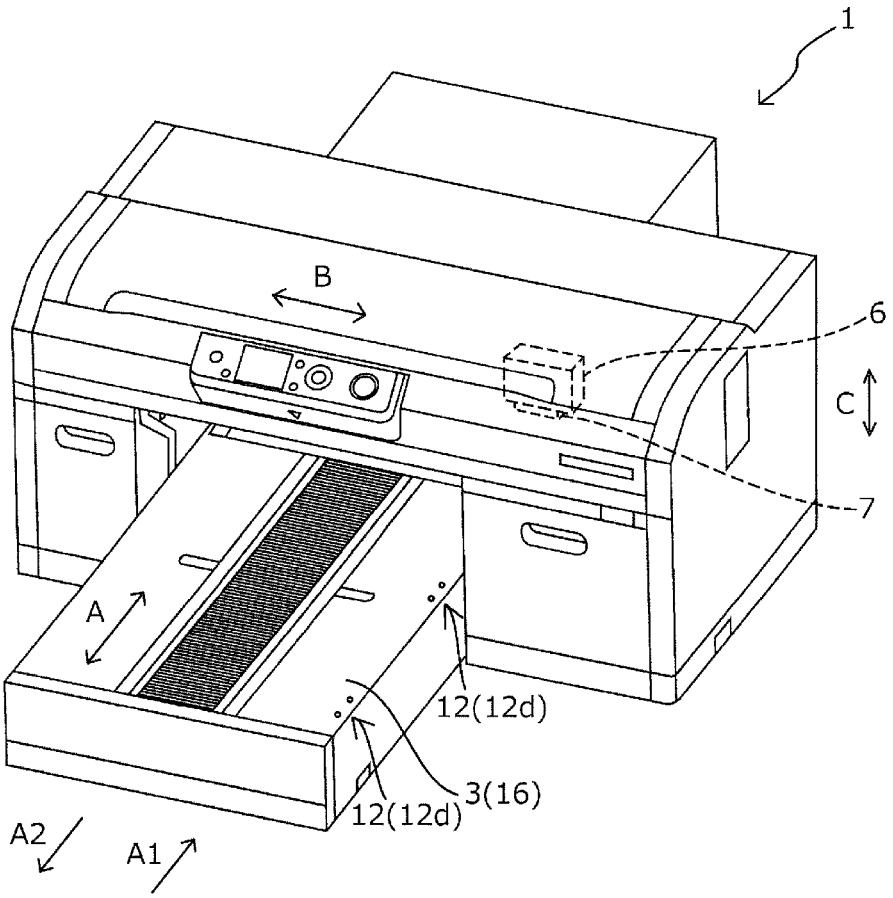
FIG. 19 is a schematic perspective view illustrating a printing apparatus according to Example 4 of the invention.

FIG. 19 is a schematic perspective view illustrating a printing apparatus 1 according to the example. Like numbers designate identical or corresponding component elements in Examples 1 and 3, described above, and detailed description for such component elements are omitted.

The printing apparatus 1 according to Example 4 is configured in a similar manner to the printing apparatus 1 according to Example 1, excluding attaching positions for a plurality of retainers 13 on the printing apparatus 1 (a position at which the attachment section 12 is formed).

As illustrated in FIG. 19, in the printing apparatus 1 according to the example, attachment sections 12 (attachment sections 12*d*) configured to allow the plurality of retainers 13 to be attached are formed at an end portion adjacent to a side face of a medium transporting section 3. In other words, the printing apparatus 1 is configured to allow the plurality of retainers 13 to be attached to one side face of the printing apparatus 1. With the configuration described above, a work to cause the frame 10 to be retained by the plurality of retainers 13 can be performed from the side of the side face.

Note that the invention is not intended to be limited to the aforementioned examples, and many variations are possible within the scope of the invention as described in the appended claims. It goes without saying that such variations also fall within the scope of the invention. For example, the plurality of retainers 13 may be attached onto both side faces of the printing apparatus 1. The plurality of retainers 13 may be attached onto another end portion opposite to the set position of the printing apparatus 1 in the movement direction A of the medium supporting unit 2.

This application claims priority under 35 U.S.C. § 119 to Japanese Patent Application No. 2017-191052, filed Sep. 29, 2017. The entire disclosure of Japanese Patent Application No. 2017-191052 is hereby incorporated herein by reference.

What is claimed is:

1. An inkjet printing apparatus comprising:

a printing unit configured to perform printing onto a medium;

a supporting unit configured to support the medium to be printed by the printing unit;

a pressing unit configured to be attachable and detachable with respect to the supporting unit and to be attached to the supporting unit to press the medium supported by the supporting unit; and a retainer configured to retain the pressing unit that is detached from the supporting unit, wherein the retainer has:

a first portion on which the pressing unit is to be hung; and a second portion positioned closer to a leading end side of the retainer than the first portion and above the first portion in a vertical direction, the leading end side being an opposite side to a side of which the retainer is to be coupled to a portion of the inkjet printing apparatus.

2. The inkjet printing apparatus according to claim 1, wherein the inkjet printing apparatus includes a plurality of the retainers.

3. The inkjet printing apparatus according to claim 2, wherein the inkjet printing apparatus has spacings among the plurality of the retainers, the spacings being configured to be adjustable.

4. The inkjet printing apparatus according to claim 1, wherein the retainer is configured to be detachable from the inkjet printing apparatus.

5. The inkjet printing apparatus according to claim 4, wherein the supporting unit is configured to be movable within a movement range, the movement range including a set position for the medium to be set, and the retainer is attached at a position allowing, when the supporting unit is positioned at the set position, the supporting unit to prevent the retainer from being detached from the inkjet printing apparatus.

6. The inkjet printing apparatus according to claim 1, further comprising an attachment section having two faces with different orientations, the retainer being attached to the attachment section, wherein the retainer has a third portion that is in contact with the two faces.

7. The inkjet printing apparatus according to claim 1, wherein the supporting unit is configured to be movable within a movement range, the movement range including a set position for the medium to be set, and the retainer is attached to an end portion on a side of the set position of the inkjet printing apparatus in a movement direction of the supporting unit.

8. A pressing unit retaining method for an inkjet printing apparatus including a printing unit configured to perform printing onto a medium, a supporting unit configured to support the medium to be printed by the printing unit, a pressing unit configured to be attachable and detachable with respect to the supporting unit and to be attached to the supporting unit to press the medium supported by the supporting unit, and a retainer having a first portion, and a second portion positioned closer to a leading end side than the first portion and above the first portion in a vertical direction, the leading end side being an opposite side to a side of which the retainer is to be coupled to a portion of the inkjet printing apparatus, the pressing unit retaining method comprising:

hanging the pressing unit on the first portion, the pressing unit being detached from the supporting unit, to retain the pressing unit.

* * * * *